United States Patent [19]

Sloppy et al.

[11] Patent Number: 4,972,576

[45] Date of Patent: Nov. 27, 1990

[54] METHOD FOR CONTAINMENT AND ALIGNMENT OF WIRE TERMINATIONS

[75] Inventors: Raymond F. Sloppy, Ramona; Robert W. Fischer, Jr., Lakeside, both of Calif.

[73] Assignee: NCR Corporation, Dayton, Ohio

[21] Appl. No.: 491,796

[22] Filed: Mar. 12, 1990

[51] Int. Cl.[5] ..... H01R 43/00

[52] U.S. Cl. ..... 29/884; 29/755; 29/758; 29/760; 269/903; 439/709; 439/719

[58] Field of Search ..... 439/719, 456, 449, 469, 439/738, 750, 452, 709; 29/755, 758, 760, 872, 876, 884; 269/43, 287, 903

[56] References Cited

U.S. PATENT DOCUMENTS

| | | | |
|---|---|---|---|
| 2,636,067 | 4/1953 | Kraft | 439/709 |
| 2,896,188 | 7/1959 | Kearney | 339/198 |
| 3,215,973 | 11/1965 | Falconer | 339/198 |
| 3,509,513 | 4/1970 | Russin | 339/14 |
| 3,512,120 | 5/1970 | Bean | 339/99 |
| 3,769,701 | 11/1973 | Kloth | 29/755 |
| 3,949,457 | 4/1976 | Fortsch | 29/755 |
| 3,957,335 | 5/1976 | Troy | 339/125 R |
| 3,960,425 | 6/1976 | Kirk et al. | 339/17 R |
| 4,059,331 | 11/1987 | Sedlacek et al. | 439/719 |
| 4,162,819 | 7/1979 | Eisert | 339/247 |
| 4,184,733 | 1/1980 | Schmeling | 339/198 H |
| 4,367,005 | 1/1983 | Douty et al. | 339/107 |
| 4,433,479 | 2/1984 | Suzuki et al. | 29/755 |
| 4,580,864 | 4/1986 | Knickerbocker | 339/98 |
| 4,753,610 | 6/1988 | Eason et al. | 439/571 |
| 4,786,260 | 11/1988 | Spaulding | 29/884 |
| 4,796,358 | 1/1989 | Long, Jr. et al. | 29/755 |
| 4,808,114 | 2/1989 | Mohri et al. | 439/76 |

*Primary Examiner*—P. W. Echols

*Attorney, Agent, or Firm*—Wilbert Hawk, Jr.; Stephen F. Jewett; Gregory P. Gadson

[57] ABSTRACT

An apparatus for containment and alignment of wire terminations has a wire holder with a slidable retainer. The front of the wire holder has oval-shaped holes for partially receiving several oval-shaped wire terminations to be connected to electronic equipment, and for reducing rotational motion of the wire terminations. Smaller holes connected to the oval-shaped holes receive the wires, but prohibit further movement of the wire terminations into the wire holder so that wire terminations uniformly protrude from the wire holder. Slots at the back of the wire holder receive the wires, which wires are frictionally locked into place by the retainer.

12 Claims, 2 Drawing Sheets

METHOD FOR CONTAINMENT AND ALIGNMENT OF WIRE TERMINATIONS

BACKGROUND OF THE INVENTION

The present invention generally relates to electrical connections, such as occur in computer hardware systems. More particularly, the present invention relates to installing and attaching a number of wire terminations to electrical terminal blocks.

Labor-intensive prior art methods of wire installation and attachment often have misconnections (incorrect connections) associated therewith, which can result in severe damage to systems. Such prior art methods include, inter alia, labeling individual wires, using tie straps to position the wire terminals, and soldering wires to fanning strips. To that end, the objects of the present invention are as follows.

SUMMARY OF THE INVENTION

It is an object of the present invention to provide a method and apparatus for containment and alignment of multiple wire terminations which reduce incidents of misconnection of the wire terminals to electrical terminal blocks.

It is also an object of the present invention to provide a method and apparatus for containment and alignment of multiple wire terminations which reduce the amount of labor required for attachment of the wire terminations to the electrical terminal blocks.

It is another object of the present invention to provide a method and apparatus for containment and alignment of multiple wire terminations in which all of the wire terminations are aligned once they are housed.

It is yet another object of the present invention to provide a method and apparatus for containment and alignment of multiple wire terminations in which the wire terminations and their associated wires are easily locked into place, and easily unlocked.

A further object of the present invention is to provide a method and apparatus (wire holder) for containment and alignment of multiple wire terminations in which the wire terminations maintain their correct positioning once housed.

There is provided in accordance with the present invention, an apparatus for containment and alignment of multiple wire terminations including, inter alia, receiving means for partially receiving the wire terminations, and locating means connected to the receiving means for establishing the location of the wire terminations in the receiving means, wherein received and located wire terminations are aligned, and available for simultaneous connection to terminals. Also included in the preferred embodiment is a locking means for locking the wire terminations in place.

The above and other objects, features, and advantages of the present invention will become apparent from the following description with reference to the attached drawings.

DETAILED DESCRIPTION OF THE INVENTION

Figures 1, 2:
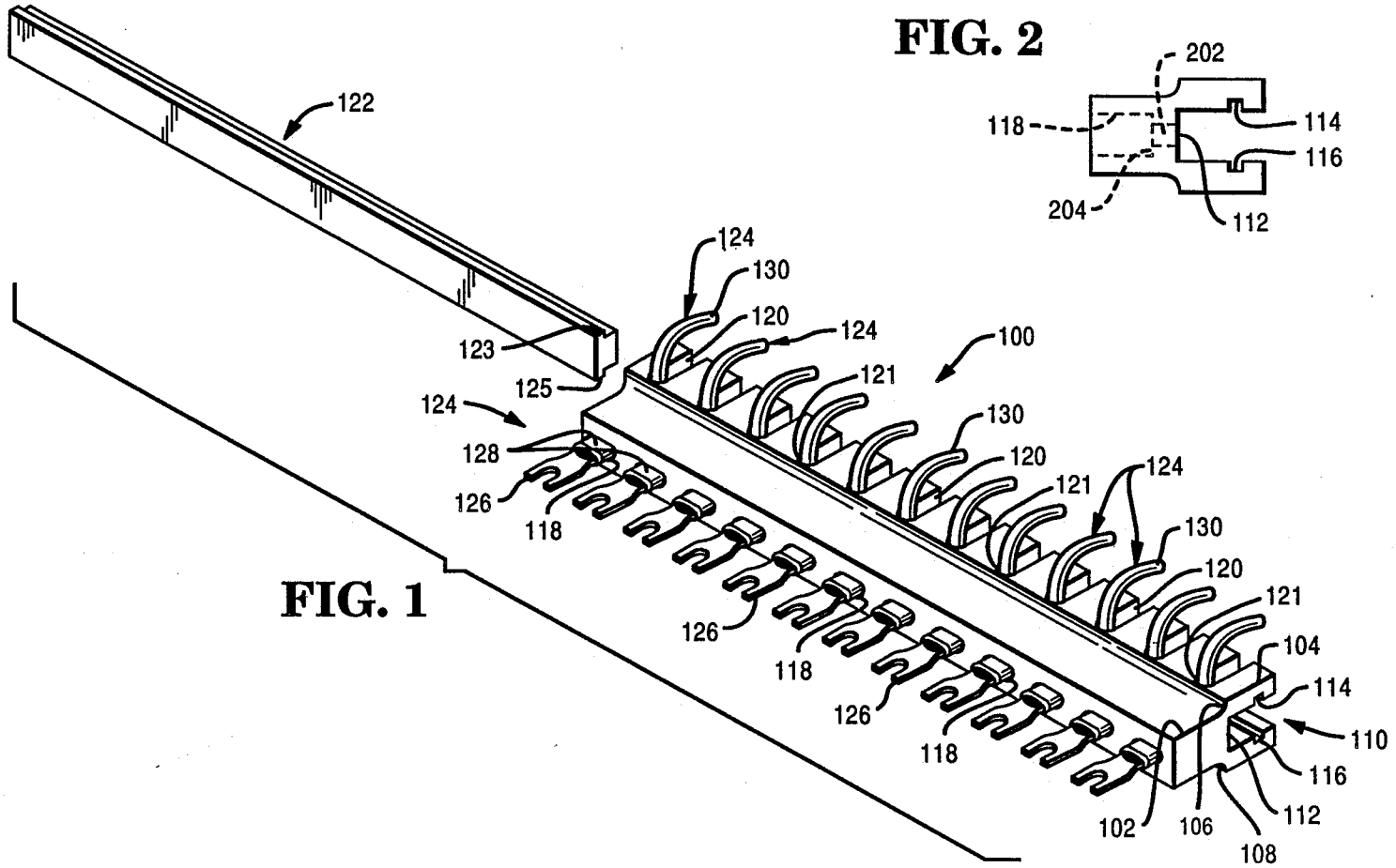
FIG. 1 is an isometric view of the present inventive wire holder with its retainer shown in a position moved away from engagement with the wires in the wire holder.
FIG. 2 is a side view of the present inventive wire holder, with the retainer and wires removed.

Referring now to FIGS. 1 and 2, a wire holder 100 is shown, which meets the previously-mentioned objects. The wire holder 100 comprises a base which has a front portion 102, and a larger (in cross-sectional area) rear portion 104. Bridging the two portions 102 and 104 are rounds 106 and 108.

The wire holder 100 has a rear hollow 110 and a number of front hollows (serving both as receiving and restricting means) 118. The rear hollow 110 has a vertical wall 112 and a pair of grooves 114 and 116 for receiving a retainer (or locking means) 122.

The upper part of the rear portion 104 has a number of slots 120, each for receiving the unterminated portion 130 ("wire") of a wire assembly 124. The slots 120 extend from the rear of the wire holder 100 (as viewed in FIG. 1) to a location close to the round 106. The wire assemblies 124 have wire terminations 126 with protective sleeves 128. The front hollows 118 are oval-shaped and have dimensions that correspond to the cross-sectional shape and dimensions of the wire terminations 126 (to be detailed infra).

Figure 3:
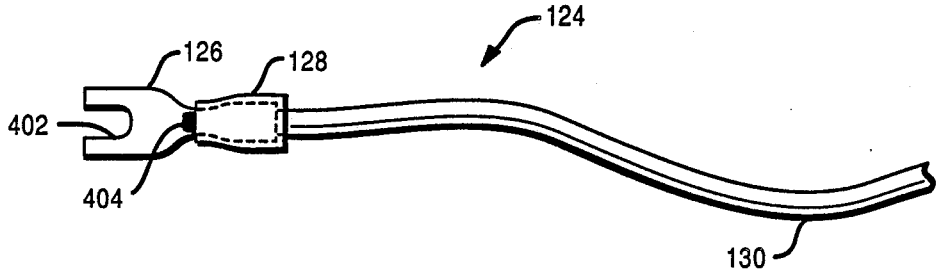
FIG. 3 is a representation of a wire before insertion into the wire holder of FIG. 1.

FIG. 3 is an illustration of a typical terminated wire assembly 124. The wire termination 126 of the wire assembly 124 is firmly crimped around an exposed conductor 404 of the coated wire 130. The protective sleeve 128 helps to preserve the bond between the conductor 404 and the wire termination 126. The wire termination 126 has a slotted portion 402 which can be connected to a terminal via a screw or similar fastening means.

The wire holder 100 is prepared for use as follows. The unterminated ends of the wires 130 are inserted into the front hollows 118, and subsequently into smaller holes 202 (illustrated by dotted lines in FIG. 2). The holes 202 and the front hollows 118 meet at an end wall 204. The wires 130 are pulled through hollows 118 and holes 202 until the wire terminations 126 (and sleeves 128) fit neatly into the hollows 118 (the wire terminations 126 and sleeves 128 are larger than the holes 202). The wires 130 are pulled up into the slots 120 to rest against the slot ends 121. Care is taken that each wire assembly 124 is matched to its correct hollow to prevent misconnections.

Figure 4:
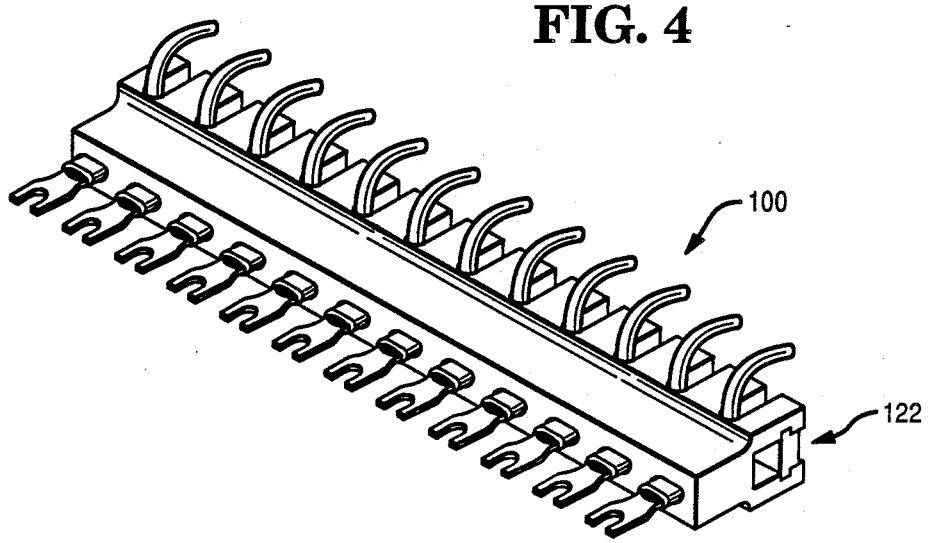
FIG. 4 is an isometric view of the present inventive wire holder with its retainer in place.

When all of the wire assemblies 124 are correctly positioned (the wire terminations 126 in their corresponding hollows 118, and the wires 130 curved from the holes 202 into the slots 120), the retainer 122 (having ledges 123 and 125 for mating with the grooves 114 and 116) is inserted into the rear hollow 110, and pushed span-wise until its ends are aligned with the ends of the wire holder 100. The retainer 122 holds the wire assemblies 124 in place by pressing against the wires 130. The fully assembled wire holder is shown in FIG. 4.

As a result of the present invention, the wire terminations are properly spaced and located with respect to the wire holder 100, and are simultaneously available for connection. Because of the matching oval shapes of the hollows 118 and wire terminations 126, rotation and other movement of the wire terminations 126 within the hollows 118 is reduced, thus making for easier placement of the wire terminations 126 at their ultimate electrical connections. Also, bending of the wires 130 through the slots 120 and installation of the retainer 122 prevents the installed wire terminations 126 from inadvertently separating from the wire holder 100. Further, incidences of incorrect wire termination connections are reduced.

Variations and modifications to the present invention are possible, given the above disclosure. However, variations and modifications which are obvious to those skilled in the art are intended to be within the scope of this letters patent.

We claim:

1. A method for containment and alignment of multiple wire terminations comprising the steps of:

establishing a plurality of recesses along a first wall of a base;

establishing a second wall at the ends of said recesses opposite said first wall;

establishing for each recess, a hole through said second wall which projects into said recess, each said hole having a smaller cross-sectional area than its corresponding recess; and inserting unterminated ends of wires into said holes until termination ends on said wires impinge upon said second wall;

wherein said wire terminations are aligned, and available for simultaneous connection to terminals.

2. The method in claim 1 further comprising the step of:

locking said wire terminations in place.

3. The method in claim 2 wherein said locking step is reversible.

4. The method in claim 2 wherein said inserting step further comprises:

restricting rotational movement of said wire terminations with said recesses.

5. The method in claim 4 wherein said recesses do not have circular cross-sections.

6. The method in claim 5 further comprising the step of:

establishing in said base, a slot aligned with each said hole, said slots for receiving unterminated wire portions.

7. The method in claim 6 wherein said locking step comprises holding said wire terminations in place by impinging upon said wires, which wires impinge upon said slots.

8. The method in claim 7 wherein said locking step is carried out via a member slidably coupled to said base.

9. The method in claim 4 further comprising the step of:

establishing in said base, a slot aligned with each said hole, said slots for receiving unterminated wire portions.

10. The method in claim 9 wherein said locking step comprises holding said wire terminations in place by impinging upon said wires, which wires impinge upon said slots.

11. The method in claim 10 wherein said locking step is carried out via a member slidably coupled to said base.

12. The method in claim 1 wherein said inserting step further comprises:

restricting rotational movement of said wire terminations with said recesses.

* * * * *